US011713858B2

(12) United States Patent
Nishimura

(10) Patent No.: US 11,713,858 B2
(45) Date of Patent: Aug. 1, 2023

(54) VEHICLE LIGHTING

(71) Applicant: Stanley Electric Co., Ltd., Tokyo (JP)

(72) Inventor: Shota Nishimura, Tokyo (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/911,427

(22) PCT Filed: Mar. 23, 2021

(86) PCT No.: PCT/JP2021/011862
§ 371 (c)(1),
(2) Date: Sep. 14, 2022

(87) PCT Pub. No.: WO2021/193588
PCT Pub. Date: Sep. 30, 2021

(65) Prior Publication Data

US 2023/0100039 A1 Mar. 30, 2023

(30) Foreign Application Priority Data

Mar. 24, 2020 (JP) ..... 2020-052029

(51) Int. Cl.
*F21S 41/265* (2018.01)
*F21S 41/663* (2018.01)
(Continued)

(52) U.S. Cl.
CPC ..... *F21S 41/265* (2018.01); *F21S 41/663* (2018.01); *F21W 2102/135* (2018.01); *F21Y 2115/10* (2016.08)

(58) Field of Classification Search
CPC ..... F21S 41/141–153; F21S 41/19; F21S 41/24–322; F21S 41/663; F21S 45/47; F21W 2102/13–135; F21Y 2115/10
See application file for complete search history.

(56) References Cited

U.S. PATENT DOCUMENTS 5,685,627 A 11/1997 Kato
10,663,134 B2 * 5/2020 Gousset-Rousseau ..... F21S 41/322
(Continued)

FOREIGN PATENT DOCUMENTS

JP 8-167301 A 6/1996
WO 2016/006138 A1 1/2016
WO 2018/043663 A1 3/2018

OTHER PUBLICATIONS

International Search Report and Written Opinion dated Jun. 1, 2021, received for PCT Application PCT/JP2021/011862, filed on Mar. 23, 2021, 9 pages including English Translation.

*Primary Examiner* — Jason M Han
(74) *Attorney, Agent, or Firm* — Xsensus LLP

(57) ABSTRACT

A projection lens has a first lens body including a first incidence section located at a side facing a first light source and an emission section located at a side opposite to the first incidence section, and a second lens body including a second incidence section located at a side facing the second light source, a refractive index of the second lens body is smaller than a refractive index of the first lens body, and a structure in which the first lens body and the second lens body abut each other while having first boundary surfaces, which are provided between the emission section and the second incidence section, and second boundary surfaces, which are provided between the first incidence section and the second incidence section from a boundary line with respect to the first boundary surfaces, interposed therebetween is provided.

6 Claims, 9 Drawing Sheets

(51) Int. Cl.
*F21Y 115/10* (2016.01)
*F21W 102/135* (2018.01)

(56) References Cited

U.S. PATENT DOCUMENTS

| | | | |
|---|---|---|---|
| 2017/0198877 | A1 | 7/2017 | Suwa et al. |
| 2019/0226658 | A1 | 7/2019 | Kawai et al. |

* cited by examiner

VEHICLE LIGHTING

CROSS-REFERENCE TO RELATED APPLICATIONS

The present application is based on PCT filing PCT/JP2021/011862, filed Mar. 23, 2021, which claims priority to JP 2020-052029, filed Mar. 24, 2020, the entire contents of each are incorporated herein by reference.

TECHNICAL FIELD

The present invention relates to vehicle lighting.

BACKGROUND ART

For example, vehicle lighting such as a headlight (headlamp) for a vehicle or the like includes a light source, a reflector configured to reflect light emitted from the light source in a direction in which the vehicle advances, a shade configured to shield (cut) some of the light reflected by the reflector, and a projection lens configured to project the light, some of which is cut by the shade, in the direction in which the vehicle advances.

In such vehicle lighting, a light distribution pattern for a low beam including a cutoff line on an upper end is formed by inverting and projecting a light source image defined by a front end of the shade using the projection lens as a passing beam (low beam).

In addition, in the vehicle lighting, a light distribution pattern for a high beam is formed above the light distribution pattern for a low beam by disposing a separate light source configured to emit light in the direction in which the vehicle advances below the shade, and projecting light emitted from the light source using the projection lens as a traveling beam (high beam).

Incidentally, in vehicle lighting disclosed in the following Patent Literature 1, instead of the above-mentioned reflector and shade, it has been proposed to form a light distribution pattern for a low beam and a light distribution pattern for a high beam using two light guide members provided to correspond to two upper and lower light sources.

CITATION LIST

Patent Literature

[Patent Literature 1]
PCT International Patent Publication No. 2018/043663

SUMMARY OF INVENTION

Technical Problem

However, in the above-mentioned vehicle lighting disclosed in Patent Literature 1, since there is an air layer (air gap) between the two light guide members, use efficiency of light emitted from the light source decreases due to Fresnel loss generated therebetween. In addition, the light distribution pattern may change due to a variation in positional accuracy of the two light guide members (in particular, an interval between air gaps). Further, when the light is totally reflected between an upper surface of the lower light guide member and the air layer, a fragment (dark section) may occur on a lower side of the light distribution pattern for a high beam.

An aspect of the present invention provides vehicle lighting capable of obtaining a good light distribution pattern.

Solution to Problem

In order to achieve the aforementioned objects, the present invention provides the following means.

(1) A vehicle lighting including:

a first light source configured to emit first light;

a second light source that is disposed adjacent to the first light source and that is configured to emit second light in a same direction as the first light; and a projection lens configured to project the first light and the second light in a same direction, wherein the projection lens has a first lens body including a first incidence section located at a side facing the first light source and an emission section located at a side opposite to the first incidence section, and a second lens body including a second incidence section located at a side facing the second light source, a refractive index of the second lens body is smaller than a refractive index of the first lens body, a structure in which the first lens body and the second lens body abut each other while having first boundary surfaces, which are provided between the emission section and the second incidence section, and second boundary surfaces, which are provided between the first incidence section and the second incidence section from a boundary line with respect to the first boundary surfaces, interposed therebetween is provided, among the first light that has entered inside of the first lens body from the first incidence section, the first light reflected at the second boundary surface is emitted to an outside of the first lens body from the emission section, and among the second light that has entered inside of the second lens body from the second incidence section, the second light that has passed through the first boundary surface and the second light that has passed through the second boundary surface are emitted to the outside of the first lens body from the emission section.

(2) The vehicle lighting according to the above-mentioned (1), wherein the emission section has a lens surface configured to condense the first light and the second light in a direction in which the boundary line extends and in a direction in which the first light source and the second light source are aligned.

(3) The vehicle lighting according to the above-mentioned (1), wherein the projection lens has a third lens body located at a side facing the emission section, the emission section has a lens surface configured to condense the first light and the second light in a direction in which the boundary line extends, and the third lens body has a lens surface configured to condense the first light and the second light emitted from the emission section in a direction in which the first light source and the second light source are aligned.

(4) The vehicle lighting according to the above-mentioned (3), wherein the third lens body is integrally assembled to the first lens body in a state in which an air layer is provided between the third lens body and the emission section.

(5) The vehicle lighting according to any one of the above-mentioned (1) to (4), wherein the first light source and the second light source are provided on a same surface of a same substrate.

(6) The vehicle lighting according to any one of the above-mentioned (1) to (5), wherein the first light projected by the projection lens forms a first light distribution pattern including a cutoff line defined by the boundary line on an upper end thereof, and the second light projected by the projection lens forms a second light distribution pattern located above the first light distribution pattern.

Advantageous Effects of Invention

According to the aspect of the present invention, it is possible to provide vehicle lighting capable of obtaining a good light distribution pattern.

DESCRIPTION OF EMBODIMENTS

Figure 1:
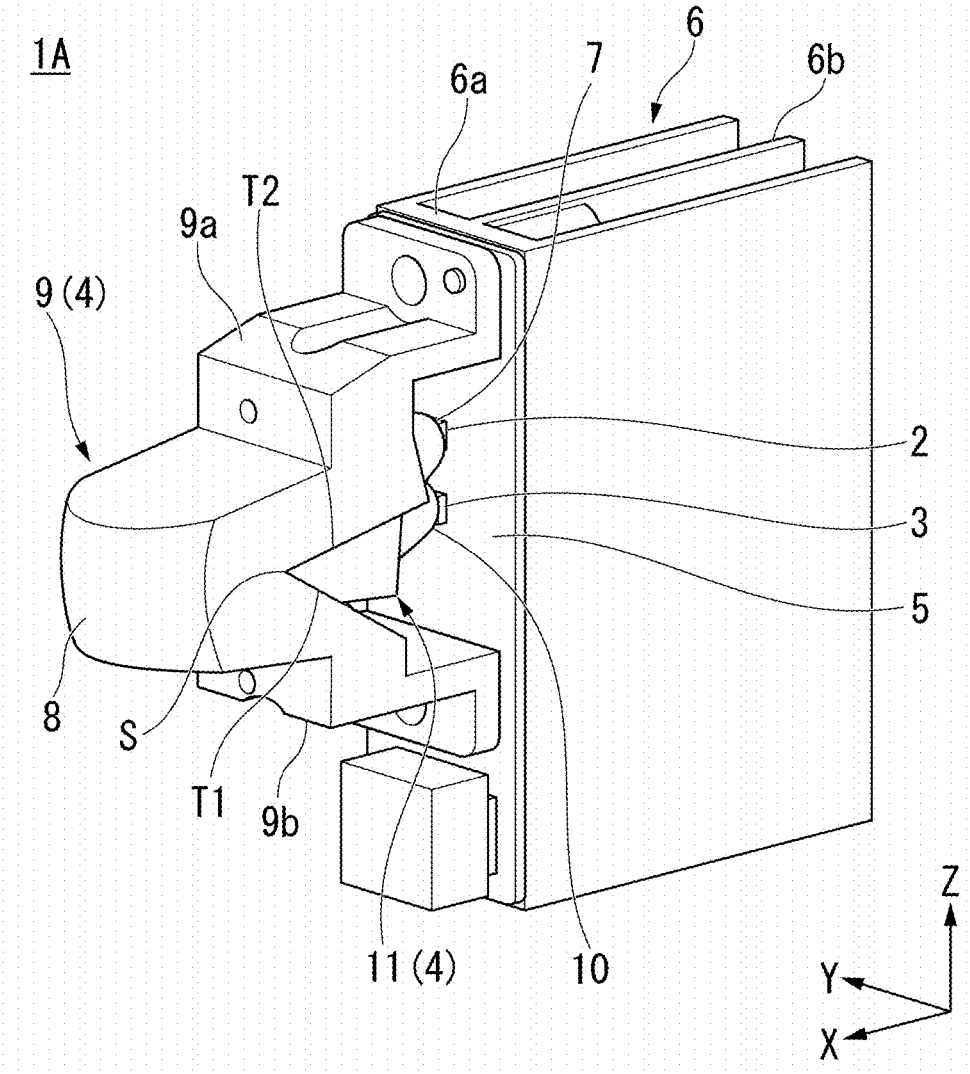
FIG. 1 is a perspective view showing a configuration of vehicle lighting according to a first embodiment of the present invention.

Hereinafter, embodiments of the present invention will be described with reference to the accompanying drawings in detail.

Further, in the drawings used in the following description, in order to make components easier to see, scales of dimensions may be shown differently depending on the components, and dimensional ratios of each of the components may not be the same as the actual ones.

In addition, in the drawings described below, an XYZ orthogonal coordinate system is set, an X-axis direction represents a forward/rearward direction of the vehicle lighting (lengthwise direction), a Y-axis direction represents a leftward/rightward direction of the vehicle lighting (widthwise direction), and a Z-axis direction represents an upward/downward direction of the vehicle lighting (height direction).

First Embodiment

First, as a first embodiment of the present invention, for example, vehicle lighting 1A shown in FIG. 1 to FIG. 5 will be described.

Figure 2:
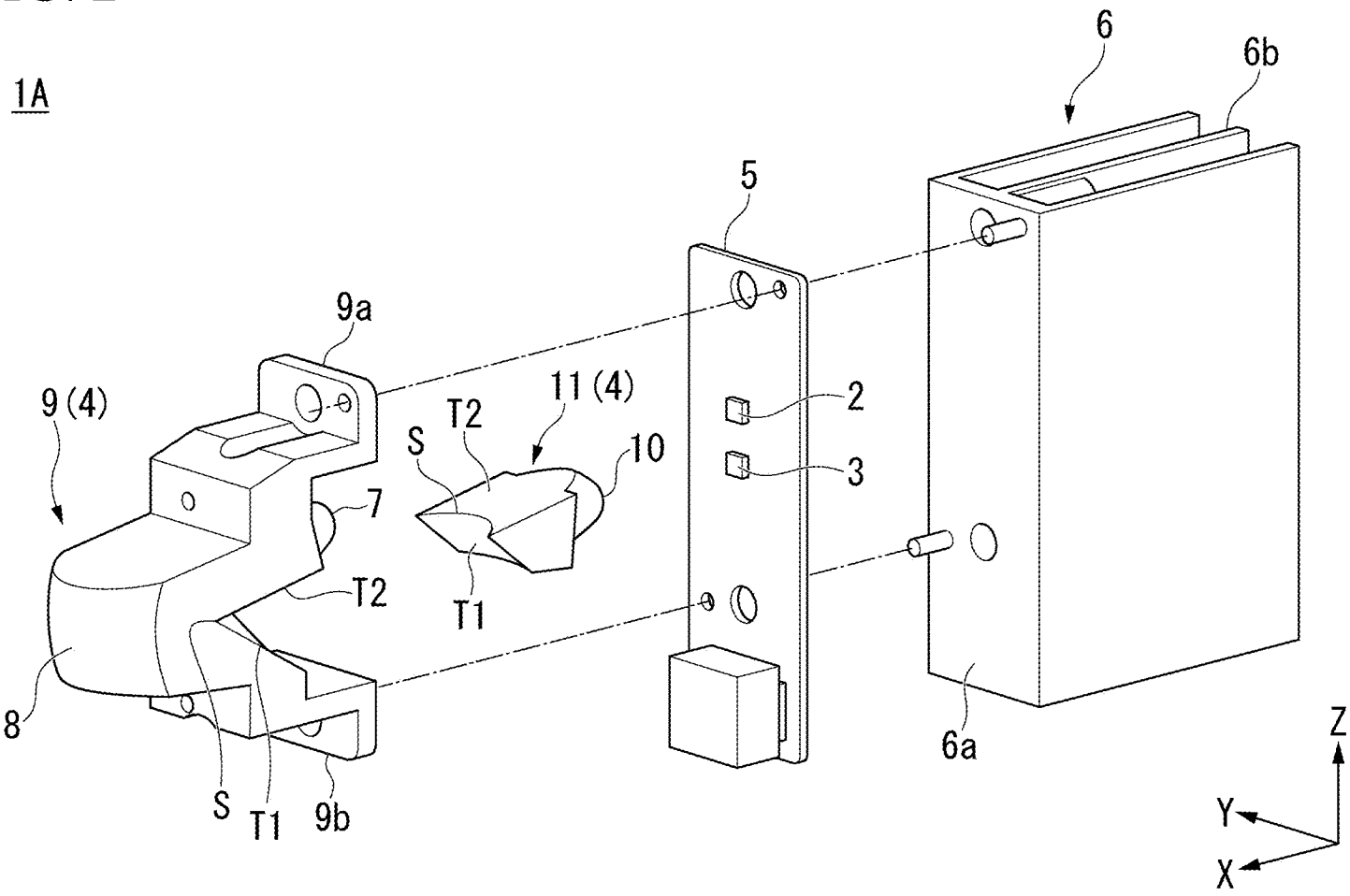
FIG. 2 is an exploded perspective view showing a configuration of the vehicle lighting shown in FIG. 1.
Figure 3:
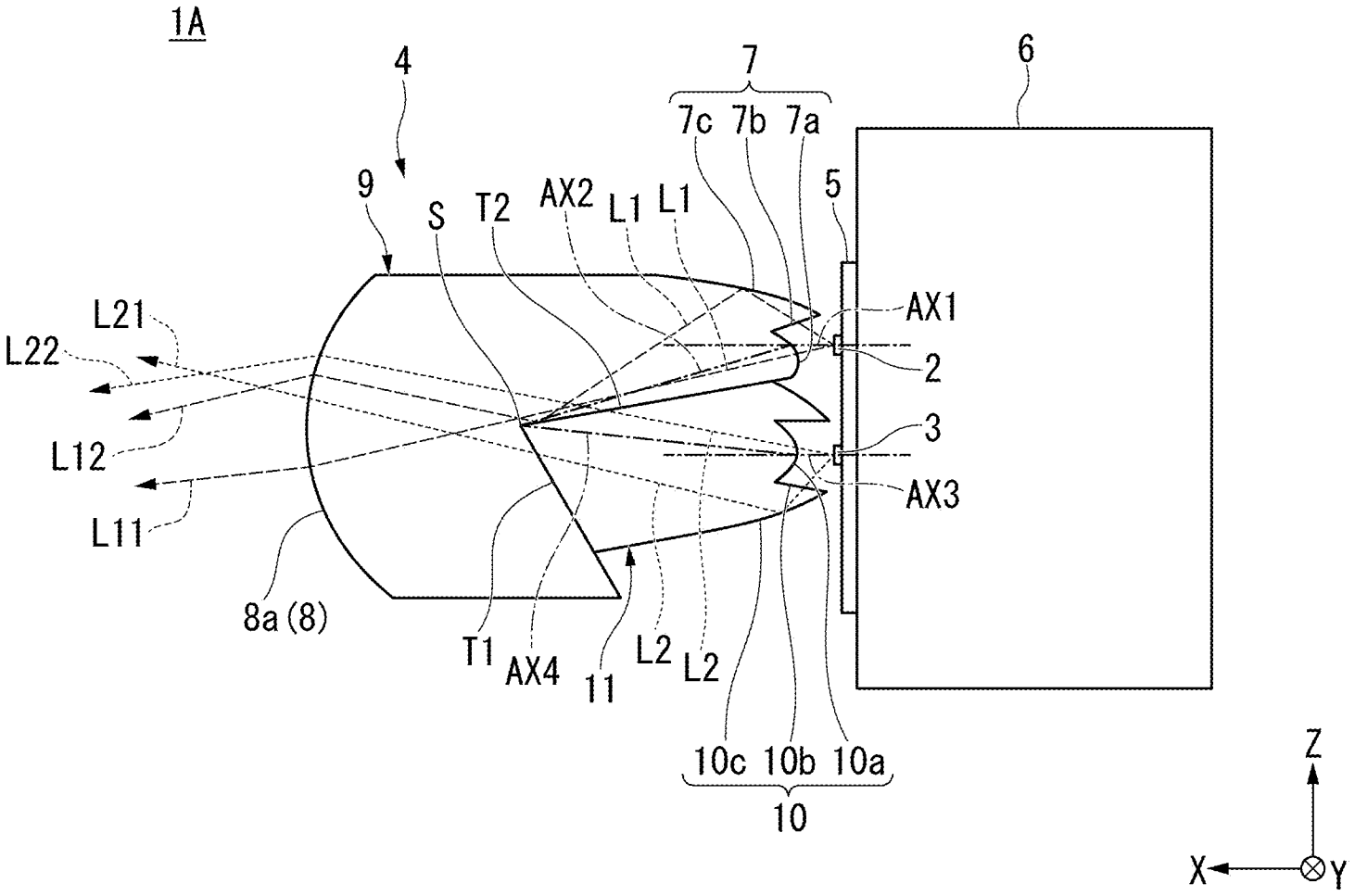
FIG. 3 is a vertical cross-sectional view showing a configuration of the vehicle lighting shown in FIG. 1.
Figure 4:
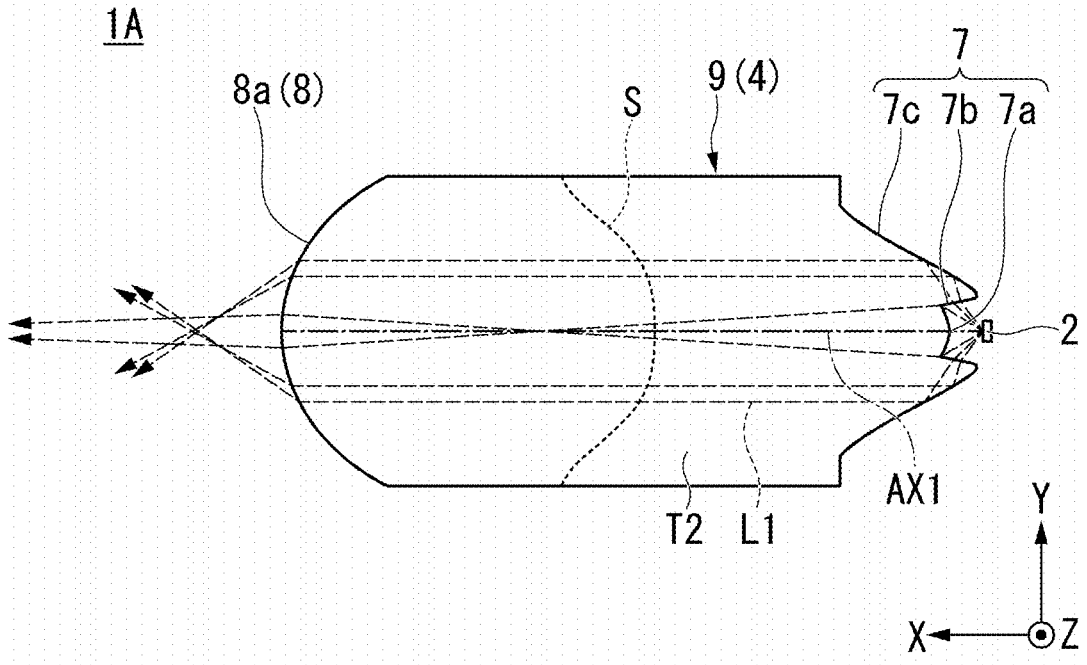
FIG. 4 is a horizontal cross-sectional view showing a configuration of the vehicle lighting shown in FIG. 1 on the side of a first incidence section.
Figure 5:
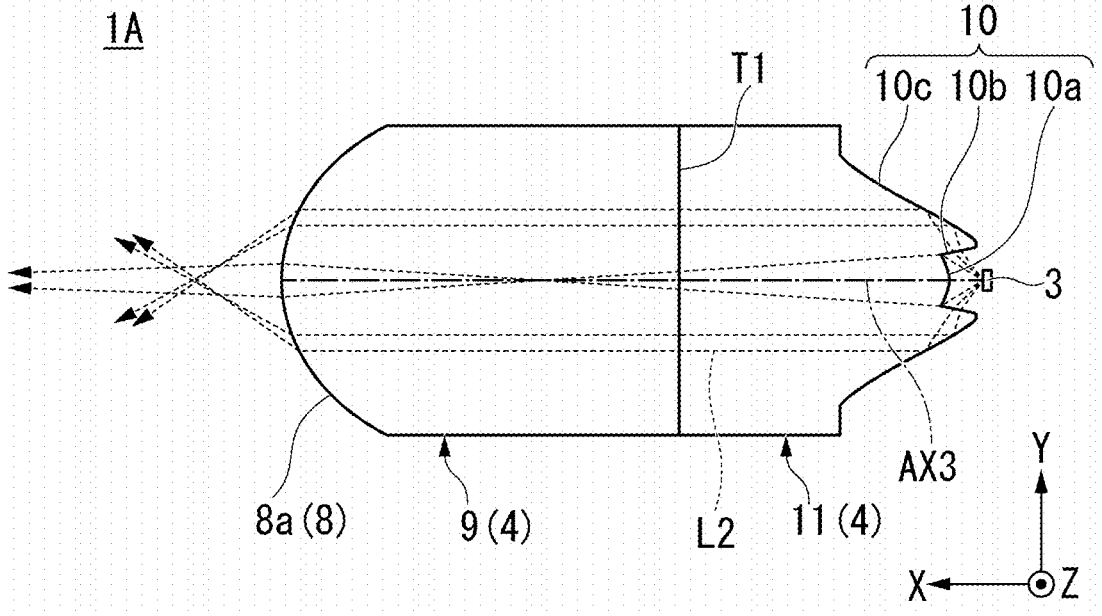
FIG. 5 is a horizontal cross-sectional view showing a configuration of the vehicle lighting shown in FIG. 1 on the side of a second incidence section.

Further, FIG. 1 is a perspective view showing a configuration of the vehicle lighting 1A. FIG. 2 is an exploded perspective view showing the configuration of the vehicle lighting 1A. FIG. 3 is a vertical cross-sectional view showing the configuration of the vehicle lighting 1A. FIG. 4 is a horizontal cross-sectional view showing a configuration of the vehicle lighting 1A on the side of a first incidence section 7. FIG. 5 is a horizontal cross-sectional view showing a configuration of the vehicle lighting 1A on the side of a second incidence section 10.

The vehicle lighting 1A of the embodiment is obtained by applying the present invention to a headlight (headlamp) for a vehicle, and a passing beam (low beam) that forms a light distribution pattern for a low beam including a cutoff line on an upper end and a traveling beam (high beam) that forms a light distribution pattern for a high beam above the light distribution pattern for a low beam can be radiated switchably toward a side in front of the vehicle (+X-axis direction).

Specifically, as shown in FIG. 1 to FIG. 5, the vehicle lighting 1A generally includes a first light source 2 configured to emit first light L1, a second light source 3 configured to emit second light L2, and a projection lens 4 configured to project the first light L1 and the second light L2, inside a lighting body (not shown).

Further, the lighting body is constituted by a housing, a front surface of which is open, and a transparent lens cover configured to cover an opening of the housing. In addition, a shape of the lighting body may be appropriately changed according to a design or the like of the vehicle.

The first light source 2 and the second light source 3 are constituted by, for example, light emitting diodes (LEDs) configured to emit white light. In addition, a high output (high brightness) type LED for vehicle illumination (for example, an SMD LED or the like) may be used as the LED. Further, as the first light source 2 and the second light source 3, a light emitting element such as a laser diode (LD) or the like can be used, in addition to the above-mentioned LED.

In the vehicle lighting 1A of the embodiment, in a state in which the first light source 2 and the second light source 3 are adjacent to each other, they are arranged next to each other in a vertical direction (upward/downward direction) of the vehicle lighting 1A. Among these, one LED that constitutes the first light source 2 is disposed on an upper side, and one LED that constitutes the second light source 3 is disposed on a lower side.

The first light source 2 and the second light source 3 are mounted on a circuit substrate 5 on the side of one surface (in the embodiment, a front surface) on which driving circuits configured to drive the LEDs are provided. Accordingly, the first light source 2 and the second light source 3 radially emit the first light L1 and the second light L2 toward the side in front (+X axis side). That is, the first light source 2 and the second light source 3 are provided on the same surface of the same circuit substrate 5, and form a configuration that emits the first light L1 and the second light L2 radially in the same direction.

In addition, a heat sink 6 configured to radiate heat emitted from the first light source 2 and the second light source 3 is attached to the circuit substrate 5 on the side of the other surface (in the embodiment, a back surface). The heat sink 6 is constituted by an extruded body formed of a metal having high thermal conductivity such as aluminum or the like. The heat sink 6 has a base section 6*a* in contact with the circuit substrate 5, and a plurality of fin sections 6*b* configured to increase a heat radiation property transferred from the circuit substrate 5 to the base section 6*a*.

Further, while a configuration in which the LEDs that constitute the first light source 2 and the second light source 3 and the driving circuit configured to drive the LEDs are mounted on the circuit substrate 5 is provided in the embodiment, a configuration in which a mounting substrate on which LEDs are mounted and a circuit substrate on which a driving circuit configured to drive the LEDs is provided are separately disposed, the mounting substrate and the circuit substrate are electrically connected via a wiring cord referred to as a harness, and a driving circuit is protected from heat emitted from the LEDs may be provided.

The projection lens 4 has the first incidence section 7 located at a side facing the first light source 2, a first lens body 9 including an emission section 8 located at a side opposite to the first incidence section 7, and a second lens body 11 including the second incidence section 10 located at a side facing the second light source 3.

In the projection lens 4, a refractive index of the second lens body 11 is smaller than a refractive index of the first lens body 9. In the embodiment, for example, the first lens body 9 is formed of a polycarbonate resin (PC), and the second lens body 11 is formed of an acryl resin (PMMA).

Further, the combination of materials having different refractive indices between the first lens body 9 and the second lens body 11 is not particularly limited to such a combination, and can be changed as appropriate. In addition, the material is not limited to the above-mentioned resin having optical transparency, and glass may also be used.

The first lens body 9 and the second lens body 11 have a structure in which they abut each other while having first boundary surfaces T1, which are provided between the emission section 8 and the second incidence section 10, and second boundary surfaces T2, which are provided between the first incidence section 7 and the second incidence section 10 from a boundary line S with respect to the first boundary surface T1, interposed therebetween.

The first boundary surface T1 is constituted by a surface that divides between the first lens body 9 and the second lens body 11 downward from the boundary line S, and is inclined diagonally rearward from the boundary line S. The second boundary surface T2 is constituted by a surface that divides between the first lens body 9 and the second lens body 11 rearward from the boundary line S, and furthermore, is inclined diagonally upward from the boundary line S. The boundary line S defines a cutoff line of the above-mentioned light distribution pattern for a low beam while extending in a horizontal direction (leftward/rightward direction) of the vehicle lighting 1A.

The first lens body 9 and the second lens body 11 are closely attached or joined by abutting the first boundary surface T1 and the second boundary surface T2 with each other without interposing an air layer between the first boundary surface T1 and the second boundary surface T2. In addition, in the projection lens 4, the first lens body 9 and the second lens body 11 formed of different resins can be integrally formed by injection molding using a mold (so-called two color formation).

In addition, the first lens body 9 has a pair of arm sections 9*a* and 9*b*. The pair of arm sections 9*a* and 9*b* are provided to extend rearward from both upper and lower sides of the first lens body 9. In addition, tip sides of the pair of arm sections 9*a* and 9*b* have a shape folded in a direction in which they are separated from each other.

In the projection lens 4, the pair of arm sections 9*a* and 9*b* are fixed to a fixing position of a bracket or the like in the lighting body together with the circuit substrate 5 through screwing. Accordingly, in a state in which intervals between the first light source 2 and third light source 3 and between the first incidence section 7 and the second incidence section 10 are held, the first lens body 9 and the second lens body 11 are positioned and fixed to the first light source 2 and the second light source 3.

The first incidence section 7 has a first condensing incidence surface 7*a* having a convex surface shape, located at a position facing the first light source 2 and through which some of the first light L1 emitted from the first light source 2 enters, a second condensing incidence surface 7*b* having a substantially cylindrical shape, located at an inner circumferential side of a portion protruding toward the first light source 2 from a position surrounding the first condensing incidence surface 7*a* and through which some of the first light L1 emitted from the first light source 2 enters, and a condensing reflection surface 7*c* having a truncated conical shape, located at an outer circumferential side of the protruded portion and configured to reflect the first light L1 entering from the second condensing incidence surface 7*b*.

In addition, since the first incidence section 7 is adjacent to the second incidence section 10 while having the second boundary surface T2 sandwiched therebetween, the first incidence section 7 has a shape in which parts on the lower sides of the first condensing incidence surface 7*a*, the second condensing incidence surface 7*b* and the condensing reflection surface 7*c* are cut along the second boundary surface T2.

In the first incidence section 7, among the first light L1 radially emitted from the first light source 2, the first light L1 entering inside of the first lens body 9 from the first condensing incidence surface 7*a* is condensed closer to an optical axis. Meanwhile, the first light L1 entering inside of the first lens body 9 from the second condensing incidence surface 7*b* is reflected at the condensing reflection surface 7*c* and condensed closer to the optical axis.

Accordingly, the first light L1 entering inside of the first lens body 9 from the first incidence section 7 is guided toward a side in front of the first lens body 9 while being condensed closer to an optical axis AX2, which is inclined diagonally downward more than an optical axis AX1 of the first light L1 emitted from the first light source 2, in a vertical cross section of the vehicle lighting 1A shown in FIG. 3.

Meanwhile, the first light L1 entering inside of the first lens body 9 from the first incidence section 7 is guided toward a side in front of the first lens body 9 while being parallelized with respect to the optical axis AX1 of the first light L1 in the horizontal cross section of the vehicle lighting 1A shown in FIG. 4. Further, regarding the first incidence section 7, in the horizontal cross section of the vehicle lighting 1A, a configuration in which the first light L1 enters inside of the first lens body 9 while condensed closer to the optical axis AX1 may be used.

In addition, the first light L1 entering inside of the first lens body 9 from the first incidence section 7 is guided toward the emission section 8 in front of the first lens body 9. Among this first light L1, the first light L1 entering the second boundary surface T2 is reflected by the second boundary surface T2 and then guided toward the emission section 8.

That is, in the second boundary surface T2, since a refractive index of a second lens 11 is smaller than a refractive index of a first lens 9, the first light L1 incident on the second boundary surface T2 can be totally reflected toward the emission section 8.

The second incidence section 10 has a first condensing incidence surface 10*a* having a convex surface shape, located at a portion facing the second light source 3 and through which some of the second light L2 emitted from the second light source 3 enters, a second condensing incidence surface 10*b* having a substantially cylindrical shape, located at an inner circumferential side of a portion protruding toward the second light source 3 from a position surrounding the first condensing incidence surface 10*a* and through which some of the second light L2 emitted from the second light source 3 enters, and a condensing reflection surface 10*c* having a truncated conical shape, located at an outer circumferential side of the protruded portion and configured to reflect the second light L2 entering from the second condensing incidence surface 10*b*.

In the second incidence section 10, among the second light L2 emitted from the second light source 3, the second light L2 entering inside of the second lens body 11 from the first condensing incidence surface 10*a* is condensed closer to the optical axis. Meanwhile, the second light L2 entering inside of the second lens body 11 from the second condensing incidence surface 10*b* is reflected by the condensing reflection surface 10*c* and is condensed closer to the optical axis by being.

Accordingly, the second light L2 entering inside of the second lens body 11 from the second incidence section 10 is guided toward a side in front of the second lens body 11 while being condensed closer to an optical axis AX4, which is inclined diagonally upward more than an optical axis AX3 of the second light L2 emitted from the second light source 3, in the vertical cross section of the vehicle lighting 1A shown in FIG. 3.

Meanwhile, the second light L2 entering inside of the second lens body 11 from the second incidence section 10 is guided toward a side in front of the second lens body 22 while being parallelized with respect to the optical axis AX3 of the second light L2 in the horizontal cross section of the vehicle lighting 1A shown in FIG. 5. Further, in the second incidence section 11, in the horizontal cross section of the vehicle lighting 1A, a configuration in which the second light L2 enters inside of the second lens body 11 while being condensed closer to the optical axis AX3 may be used.

In addition, the second light L2 entering inside of the second lens body 11 from the second incidence section 10 passes through the first boundary surface T1 and the second boundary surface T2 in front of the second lens body 22 and enters inside of the first lens body 9. The second light L2 entering inside of the first lens body 9 is guided toward the emission section 8.

That is, in the first boundary surface T1 and the second boundary surface T2, since the refractive index of the second lens 11 is smaller than the refractive index of the first lens 9, the second light L2 incident on the first boundary surface T1 and the second boundary surface T2 can be transmitted toward the emission section 8.

The emission section 8 has an emitting surface 8*a* on the side of the front surface of the first lens body 9. The emitting surface 8*a* is constituted by a convex lens surface having a spherical shape or a non-spherical shape configured to condense the first light L1 and the second light L2 in a vertical direction (a direction in which the first light source 2 and the second light source 3 are aligned) and a horizontal direction (a direction in which the boundary line S extends) of the vehicle lighting 1A. In addition, a focus of the convex lens surface is set to the boundary line S or in the vicinity thereof.

In the emission section 8, the first light L1 and the second light L2 guided into inside of the first lens body 9 are emitted to the outside of the first lens body 9 while being condensed by the emitting surface 8*a*. In addition, in the emission section 8, after the first light L1 and the second light L2 emitted from the emitting surface 8*a* are condensed, the first light L1 and the second light L2 are enlarged and projected toward a side in front of the first lens body 9 (the projection lens 4) while being diffused in the horizontal direction and the vertical direction of the vehicle lighting 1A.

Further, in the surfaces that constitute the first lens body 9 and the second lens body 11, the other surfaces that are not shown or explained can be freely designed (for example, blocking, or the like) within a range in which there is no bad influence on the first light L1 and the second light L2 passing through the first lens body 9 and the second lens body 11.

In the vehicle lighting 1A of the embodiment having the above-mentioned configuration, the first light L1 emitted from the first light source 2 is projected by the projection lens 4 in a direction in which the vehicle advances as a passing beam (low beam). Here, the first light L1 projected toward a side in front of the projection lens 4 forms a light distribution pattern for a low beam (first light distribution pattern), which includes a cutoff line defined by the boundary line S on the upper end, by inverting and projecting a light source image formed in the vicinity of the focus of the emitting surface 8*a*.

Meanwhile, in the vehicle lighting 1A of the embodiment, the first light L1 and the second light L2 emitted from the first light source 2 and the second light source 3 are projected by the projection lens 4 in a direction in which the vehicle advances as a traveling beam (high beam). Here, the second light L2 projected toward the side in front of the projection lens 4 forms a second light distribution pattern located above the light distribution pattern for a low beam (first light distribution pattern). The light distribution pattern for a high beam is formed by overlapping the second light distribution pattern and the light distribution pattern for a low beam (second light distribution pattern) formed by the first light L1.

In the vehicle lighting 1A of the embodiment, the first light L1 emitted from the above mentioned first light source 2 enters inside of the first lens body 9 from the first incidence section 7. Here, the first light L1 entering the inside of the first lens body 9 from the first incidence section 7 is guided toward a side in front of the first lens body 9 while being condensed closer to the optical axis AX2, which is inclined downward diagonally more than the optical axis AX1 of the first light L1 emitted from the first light source 2, in the vertical cross section of the vehicle lighting 1A shown in FIG. 3.

Figure 11:
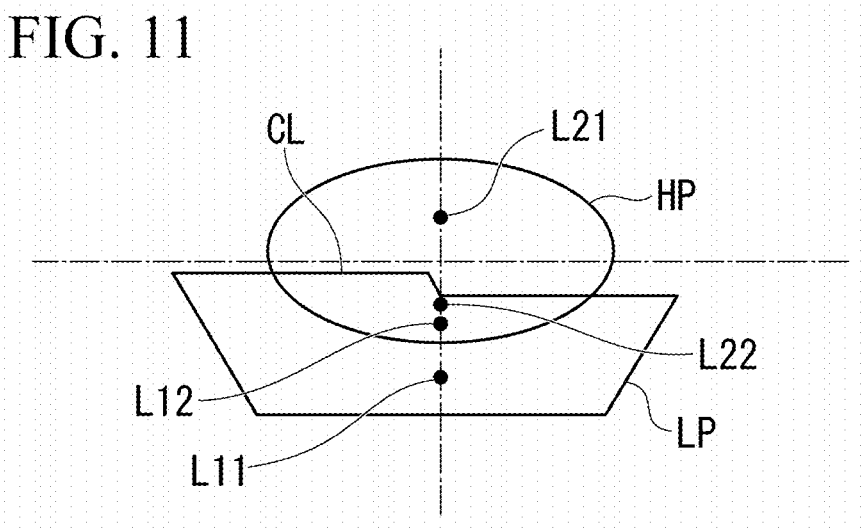
FIG. 11 is a schematic diagram showing a light distribution pattern for a low beam formed by first light and a light distribution pattern for a high beam formed by second light.

Among this, the first light L11 guided toward the emission section 8 is emitted to the outside of the first lens body 9 from the emission section 8. Accordingly, the first light L11 forms a light distribution pattern below a line H-H in the light distribution pattern for a low beam LP shown in FIG. 11.

Meanwhile, the first light L12 entering the second boundary surface T2 is guided toward the emission section 8 after being reflected at the second boundary surface T2, and is emitted to the outside of the first lens body 9 from the emission section 8. Accordingly, the first light L12 forms a light distribution pattern at the vicinity of a cutoff line CL in the light distribution pattern for a low beam LP shown in FIG. 11.

In addition, in the vehicle lighting 1A of the embodiment, the second light L2 emitted from the second light source 3 enters inside of the second lens body 11 from the second incidence section 10. Here, the second light L2 entering inside of the second lens body 11 from the second incidence section 10 is guided toward a side in front of the second lens body 11 while being condensed closer to the optical axis AX4, which is inclined upward diagonally more than the optical axis AX3 of the second light L2 emitted from the second light source 3, in the vertical cross section of the vehicle lighting 1A shown in FIG. 3.

Among this, the second light L21 incident on the first boundary surface T1 passes through the first boundary surface T1, is guided toward the emission section 8 after being incident into the first lens body 9, and then, is emitted to the outside of the first lens body 9 from the emission section 8. Accordingly, the second light L21 forms a light distribution pattern above a line H-H in a light distribution pattern for a high beam HP shown in FIG. 11.

Meanwhile, the second light L22 incident on the second boundary surface T2 passes through the second boundary surface T2, is guided toward the emission section 8 after being incident into the first lens body 9, and then is emitted to the outside of the first lens body 9 from the emission section 8. Accordingly, the second light L22 forms a light distribution pattern on a lower side in the light distribution pattern for a high beam HP shown in FIG. 11.

In addition, the second light L22 incident on the second boundary surface T2 approaches a position or a beam angle of the first light L12 reflected by the second boundary surface T2 when passing through the second boundary surface T2. Accordingly, since the second light L22 is emitted below the cutoff line CL of the light distribution pattern for a low beam LP, it is possible to overlap the lower side of the light distribution pattern for a high beam HP shown in FIG. 11 and the cutoff line CL of the light distribution pattern for a low beam LP.

As described above, in the headlight 1A for a vehicle of the embodiment, it is possible to obtain a good light distribution pattern for a low beam and a good light distribution pattern for a high beam by projecting the above mentioned first light L1 and the second light L2 emitted from the first light source 2 and the second light source 3 using the projection lens 4.

In addition, in the headlight 1A for a vehicle of the embodiment, the first lens body 9 and the second lens body 11 that constitute the projection lens 4 cause the first boundary surface T1 and the second boundary surface T2 to abut each other, and thus, they are closely attached and joined to each other without having an air layer present between the first boundary surface T1 and the second boundary surface T2.

Accordingly, in the headlight 1A for a vehicle of the embodiment, it is possible to prevent occurrence of Fresnel loss between the first boundary surface T1 and the second boundary surface T2, and to increase use efficiency of the first light L1 and the second light L2 emitted from the first light source 2 and the second light source 3.

Second Embodiment

Next, as a second embodiment of the present invention, for example, vehicle lighting 1B shown in FIG. 6 to FIG. 10 will be described.

Figure 6:
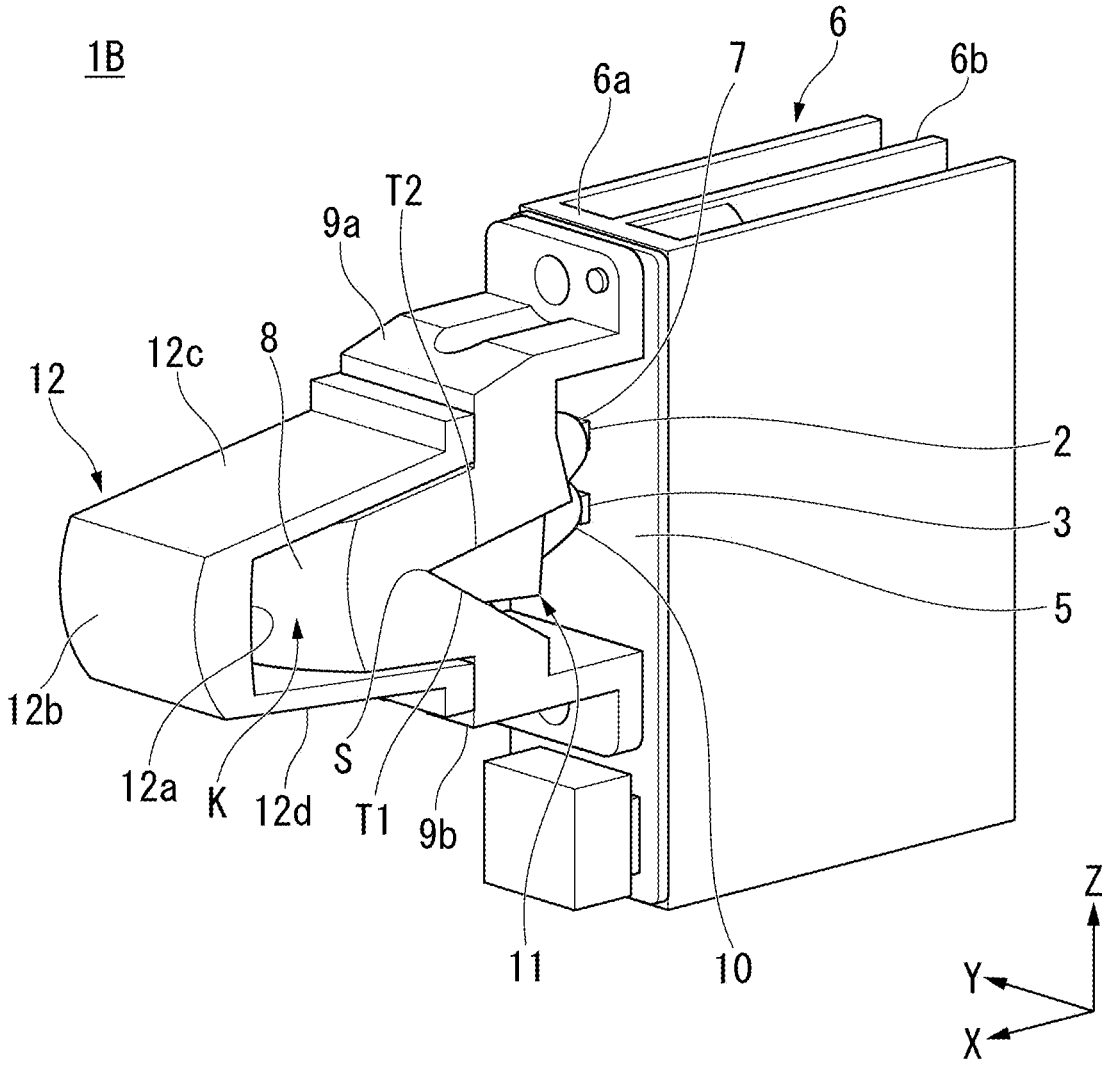
FIG. 6 is a perspective view showing a configuration of vehicle lighting according to a second embodiment of the present invention.
Figure 7:
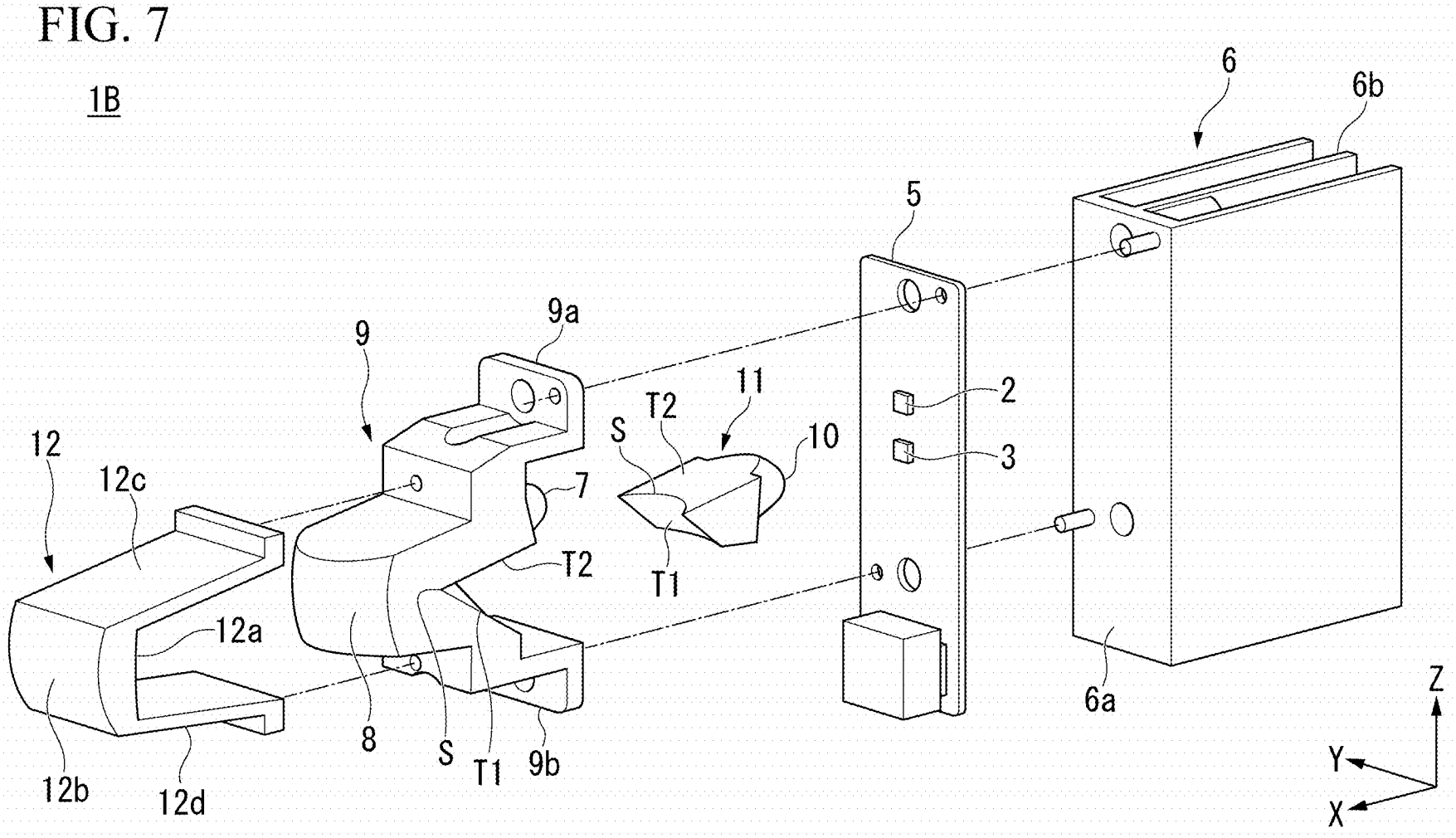
FIG. 7 is an exploded perspective view showing a configuration of the vehicle lighting shown in FIG. 6.
Figure 8:
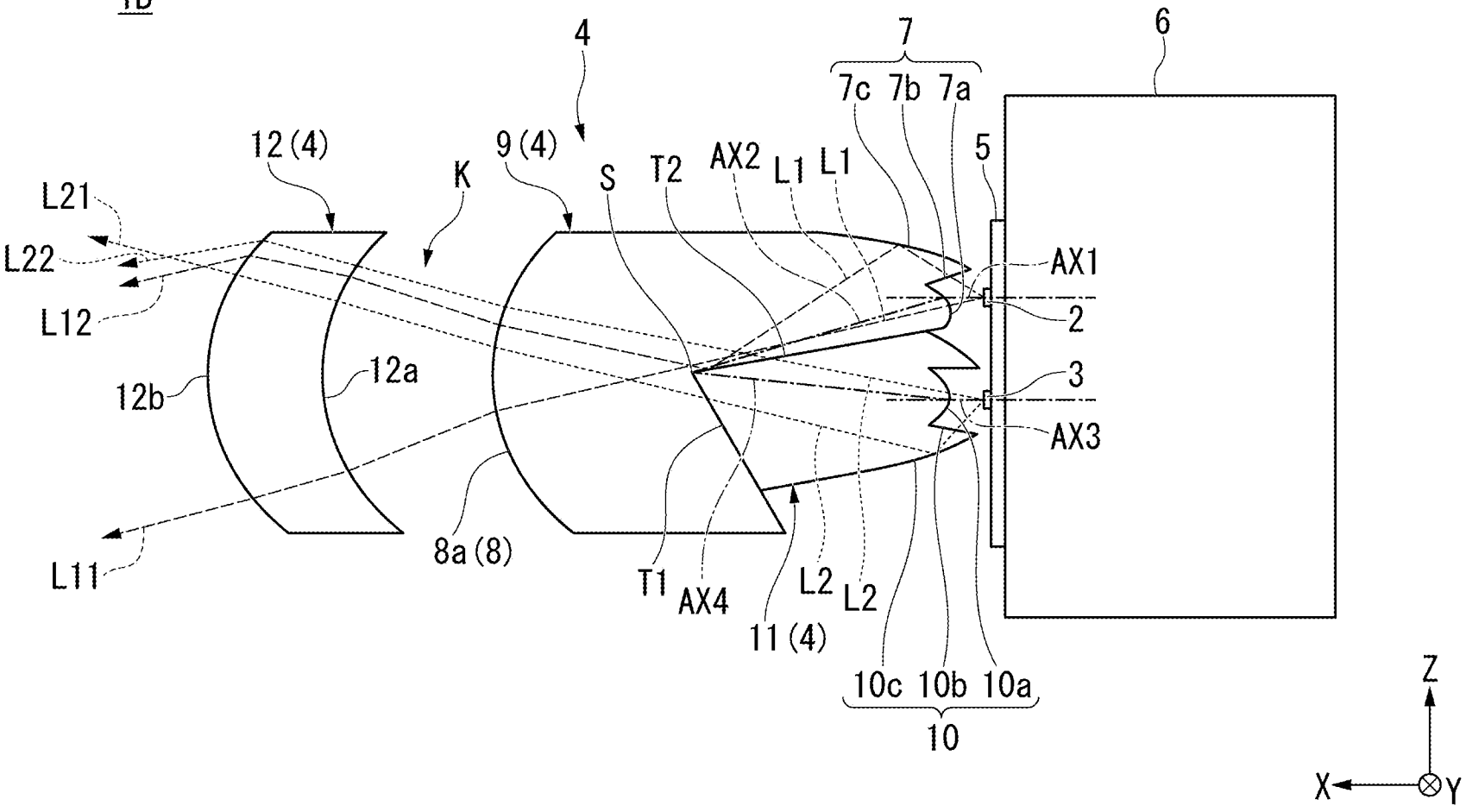
FIG. 8 is a vertical cross-sectional view showing a configuration of the vehicle lighting shown in FIG. 6.
Figure 9:
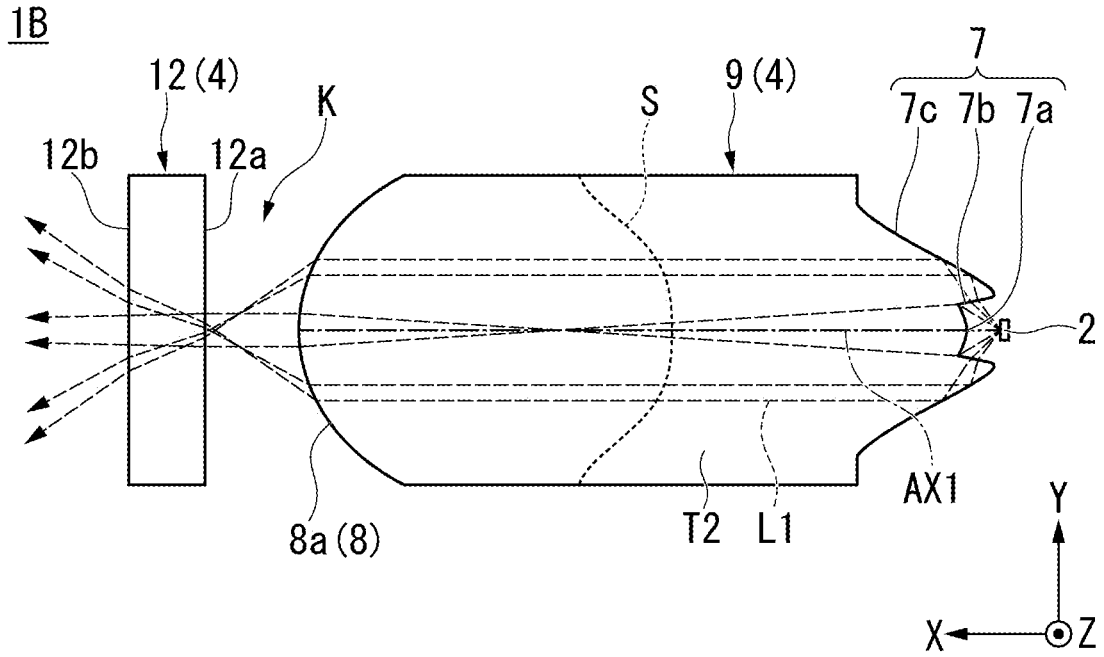
FIG. 9 is a horizontal cross-sectional view showing a configuration of the vehicle lighting shown in FIG. 6 on the side of a first incidence section.
Figure 10:
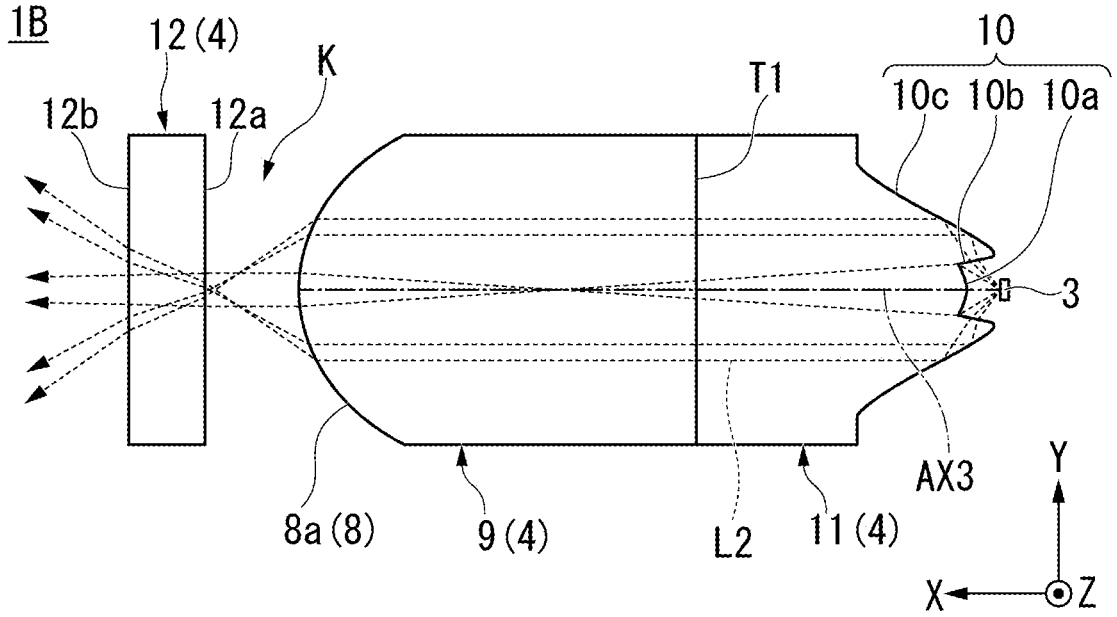
FIG. 10 is a horizontal cross-sectional view showing a configuration of the vehicle lighting shown in FIG. 6 on the side of a second incidence section.

Further, FIG. 6 is a perspective view showing a configuration of the vehicle lighting 1B. FIG. 7 is an exploded perspective view showing a configuration of the vehicle lighting 1B. FIG. 8 is a vertical cross-sectional view showing a configuration of the vehicle lighting 1B. FIG. 9 is a horizontal cross-sectional view showing a configuration of the vehicle lighting 1B on the side of the first incidence section 7. FIG. 10 is a horizontal cross-sectional view showing a configuration of the vehicle lighting 1B on the side of the second incidence section 10. In addition, in the following description, the same parts as those of the vehicle lighting 1A are designated by the same reference signs in the drawings and description thereof will be omitted.

As shown in FIG. 6 to FIG. 10, the vehicle lighting 1B of the embodiment includes a third lens body 12 that constitutes the projection lens 4, in addition to the configuration of the vehicle lighting 1A.

That is, the projection lens 4 has the third lens body 12 located at a position facing the emission section 8, together with the first lens body 9 and the second lens body 11.

The third lens body 12 has an incidence surface 12*a*, on which the first light L1 and the second light L2 are incident, on the side of a back surface thereof, and an emitting surface 12*b*, from which the first light L1 and the second light L2 are emitting, on the side of a front surface thereof.

The first incidence surface 12*a* is constituted by a substantially semi-cylindrical concave lens surface, a cylindrical axis of which extends in the horizontal direction, so as to condense the first light L1 and the second light L2 in the vertical direction of the vehicle lighting 1A.

The second emitting surface 12*b* is constituted by a substantially semi-cylindrical convex lens surface, a cylindrical axis of which extends in the horizontal direction, to condense the first light L1 and the second light L2 in the vertical direction of the vehicle lighting 1A.

In addition, in the vehicle lighting 1B of the embodiment, a synthesized focus of a synthesized lens constituted by the emitting surface 8*a* of the first lens body 9, and the incidence surface 12*a* and the second emitting surface 12*b* of the second lens body 12 is set at the boundary line S or in the vicinity thereof.

Further, while the configuration in which the emission section 8 has the emitting surface 8*a* configured to condense the first light L1 and the second light L2 in the vertical direction and in the horizontal direction of the vehicle lighting 1A is provided, in the case in which the third lens body 12 is provided, the emitting surface 8*a* configured to condense the first light L1 and the second light L2 only in the horizontal direction of the vehicle lighting 1A may be provided.

In this case, the emitting surface 8*a* may be constituted by a substantially semi-cylindrical convex lens surface, a cylindrical axis of which extends in the vertical direction, so as to condense the first light L1 and the second light L2 in the horizontal direction of the vehicle lighting 1A.

In addition, the third lens body 12 is not limited to the body in which the incidence surface 12*a* is constituted by the concave lens surface, and may be a body in which the incidence surface 12*a* is constituted by a planar surface.

The third lens body 12 is integrally combined with the first lens body 9 in a state in which an air layer K is provided between the third lens body 12 and the emission section 8. The third lens body 12 has a pair of arm sections 12*c* and 12*d*. The pair of arm sections 12*c* and 12*d* are provided to extend rearward from both upper and lower sides of the third lens body 12. In addition, tip sides of the pair of arm sections 12*c* and 12*d* have a shape folded in a direction in which they are separated from each other.

In the projection lens 4, in a state in which the first lens body 9 is sandwiched between the pair of arm sections 12*c* and 12*d*, the pair of arm sections 12*c* and 12*d* are positioned and fixed to the first lens body 9. Accordingly, in a state in which the air layer K is provided between the incidence surface 12*a* and the emitting surface 8*a*, the first lens body 9 and the third lens body 12 are integrally assembled to each other.

Further, in the surfaces that constitute the third lens body 12, the other surfaces, illustration or description of which is omitted, can be freely designed (for example, blocked or the like) without exerting a bad influence on the first light L1 and the second light L2 passing through the third lens body 12.

In the vehicle lighting 1B of the embodiment having the above-mentioned configuration, the first light L1 emitted from the first light source 2 is projected by the projection lens 4 in a direction in which the vehicle advances as a passing beam (low beam). Here, the first light L1 projected toward a side in front of the projection lens 4 forms a light distribution pattern for a low beam (first light distribution pattern) including a cutoff line defined by the boundary line S on the upper end by inverting and projecting a light source image formed in the vicinity of the focus of the emitting surface 8*a*.

Meanwhile, in the vehicle lighting 1B of the embodiment, the first light L1 and the second light L2 emitted from the first light source 2 and the second light source 3 are projected by the projection lens 4 in a direction in which the vehicle advances as a traveling beam (high beam). Here, the second light L2 projected toward a side in front of the projection lens 4 forms a second light distribution pattern located above the light distribution pattern for a low beam (first light distribution pattern). The light distribution pattern for a high beam is formed by overlapping the second light distribution pattern and the light distribution pattern for a low beam (second light distribution pattern) formed by the first light L1.

In the vehicle lighting 1B of the embodiment, the first light L1 emitted from the first light source 2 enters inside of the first lens body 9 from the first incidence section 7. Here, the first light L1 entering inside of the first lens body 9 from the first incidence section 7 is guided toward a side in front of the first lens body 9 while being condensed closer to the optical axis AX2, which is inclined downward diagonally more than the optical axis AX1 of the first light L1 emitted from the first light source 2, in the vertical cross section of the vehicle lighting 1B shown in FIG. 8.

Among this, first light L11 guided toward the emission section 8 is emitted to the outside of the first lens body 9 from the emission section 8. Further, the light L11 emitted to the outside of the first lens body 9 enters inside of the third lens body 12 from the incidence surface 12*a* via the air layer K, and is emitted to the outside of the third lens body 12 from the emitting surface 12*b*. Accordingly, the first light L11 forms a light distribution pattern below the line H-H in the light distribution pattern for a low beam LP shown in FIG. 11.

Meanwhile, first light L12 incident on the second boundary surface T2 is guided toward the emission section 8 after being reflected at the second boundary surface T2, and is emitted to the outside of the first lens body 9 from the emission section 8. Further, the light L12 emitted to the outside of the first lens body 9 enters inside of the third lens body 12 from the incidence surface 12*a* via the air layer K, and is emitted to the outside of the third lens body 12 from the emitting surface 12*b*. Accordingly, the first light L12 forms a light distribution pattern in the vicinity of the cutoff line CL in the light distribution pattern for a low beam LP shown in FIG. 11.

In addition, in the vehicle lighting 1B of the embodiment, the second light L2 emitted from the above mentioned second light source 3 enters inside of the second lens body 11 from the second incidence section 10. Here, the second light L2 entering inside of the second lens body 11 from the second incidence section 10 is guided toward a side in front of the second lens body 11 while being condensed closer to the optical axis AX4 inclined, which is inclined upward diagonally more than the optical axis AX3 of the second light L2 emitted from the second light source 3, in the vertical cross section of the vehicle lighting 1A shown in FIG. 8.

Among this, second light L21 incident on the first boundary surface T1 passes through the first boundary surface T1, is guided toward the emission section 8 after being incident into inside of the first lens body 9, and then, is emitted to the outside of the first lens body 9 from the emission section 8. Further, the light L21 emitted to the outside of the first lens body 9 enters inside of the third lens body 12 from the incidence surface 12*a* via the air layer K, and is emitted to the third lens body 12 from the emitting surface 12*b*. Accordingly, the second light L21 forms a light distribution pattern above the line H-H in the light distribution pattern for a high beam HP shown in FIG. 11.

Meanwhile, second light L22 entering the second boundary surface T2 passes through this second boundary surface T2, is guided toward the emission section 8 after being incident on the first lens body 9, and then, is emitted to the outside of the first lens body 9 from the emission section 8. Further, the light L22 emitted to the outside of the first lens body 9 enters inside of the third lens body 12 from the incidence surface 12*a* via the air layer K, and is emitted to the outside of the third lens body 12 from the emitting surface 12*b*. Accordingly, the second light L22 forms a light distribution pattern on a lower side in the light distribution pattern for a high beam HP shown in FIG. 11.

In addition, the second light L22 incident on the second boundary surface T2 approaches a position or a beam angle of the first light L12 reflected at the second boundary surface T2 when passing through the second boundary surface T2. Accordingly, since the second light L22 is emitted below the cutoff line CL of the light distribution pattern for a low beam LP, it is possible to overlap a lower section of the light distribution pattern for a high beam HP shown in FIG. 11 and the cutoff line CL of the light distribution pattern for a low beam LP.

As described above, in the headlight 1B for a vehicle of the embodiment, it is possible to obtain a good light distribution pattern for a low beam and a good light distribution pattern for a high beam, by projecting the first light L1 and the second light L2 emitted from the first light source 2 and the second light source 3 using the projection lens 4.

In addition, in the headlight 1B for a vehicle of the embodiment, the first lens body 9 and the second lens body 11 that constitute the projection lens 4 are closely attached or joined to each other without interposing the air layer between the first boundary surface T1 and the second boundary surface T2 by causing the first boundary surface T1 and the second boundary surface T2 to abut each other.

Accordingly, in the headlight 1B for a vehicle of the embodiment, it is possible to prevent occurrence of Fresnel loss at between the first boundary surfaces T1 and the second boundary surfaces T2, and it is possible to increase use efficiency of the first light L1 and the second light L2 emitted from the first light source 2 and the second light source 3.

In the vehicle lighting 1B of the embodiment, it is possible to share a function of condensing the first light L1 and the second light L2 in the vertical direction of the vehicle lighting 1B and a function of condensing the first light L1 and the second light L2 in the horizontal direction of the vehicle lighting 1B between the emission section 8 and the third lens body 12 of the first lens body 9 by adding the third lens body 12.

Further, the present invention is not necessarily limited to the embodiment and various modifications may be made without departing from the scope of the present invention.

For example, the vehicle lighting to which the present invention is applied is appropriately used for the headlight (headlamp) for a vehicle, the vehicle lighting to which the present invention is applied is not limited to the above-mentioned front vehicle lighting, and for example, the present invention can also be applied to a rear vehicle lighting such as a rear combination lamp or the like.

That is, the present invention can be widely applied to the vehicle lighting including the first light source configured to emit first light, a second light source disposed adjacent to the first light source and configured to emit second light in the same direction as the first light, and the projection lens configured to project the first light and the second light in the same direction.

In addition, the color of the first light and the second light is also not limited to the above-mentioned white light, and may be appropriately changed according to a purpose thereof, for example, red light, orange light, or the like. Further, a configuration of causing the first light source and the second light source to selectively emit the first light and the second light having different colors may be provided.

In addition, in the vehicle lightings 1A and 1B, while the direction in which the first light source 2 and the second light source 3 are arranged is the vertical direction of the vehicle lightings 1A and 1B and the direction in which the boundary line S extends is the horizontal direction of the vehicle lightings 1A and 1B, the present invention can also be applied to the vehicle lighting in which the direction in which the first light source and the second light source are arranged is the horizontal direction of the vehicle lighting and the direction in which the boundary line extends in the vertical direction of the vehicle lighting.

REFERENCE SIGNS LIST

1A, 1B Vehicle lighting
2 First light source
3 Second light source
4 Projection lens
5 Circuit substrate
6 Heat sink
7 First incidence section
8 Emission section
9 First lens body
10 Second incidence section
11 Second lens body
12 Third lens body
T1 First boundary surface
T2 Second boundary surface
S Boundary line
L1 First light
L2 Second light

The invention claimed is:

1. A vehicle lighting comprising:

a first light source configured to emit first light;

a second light source that is disposed adjacent to the first light source and that is configured to emit second light in a same direction as the first light; and a projection lens configured to project the first light and the second light in a same direction, wherein the projection lens has a first lens body including a first incidence section located at a side facing the first light source and an emission section located at a side opposite to the first incidence section, and a second lens body including a second incidence section located at a side facing the second light source, a refractive index of the second lens body is smaller than a refractive index of the first lens body, a structure in which the first lens body and the second lens body abut each other while having first boundary surfaces, which are provided between the emission section and the second incidence section, and second boundary surfaces, which are provided between the first incidence section and the second incidence section from a boundary line with respect to the first boundary surfaces, interposed therebetween is provided, among the first light that has entered inside of the first lens body from the first incidence section, the first light reflected at the second boundary surface is emitted to an outside of the first lens body from the emission section, and among the second light that has entered inside of the second lens body from the second incidence section, the second light that has passed through the first boundary surface and the second light that has passed through the second boundary surface are emitted to the outside of the first lens body from the emission section.

2. The vehicle lighting according to claim 1, wherein the emission section has a lens surface configured to condense the first light and the second light in a direction in which the boundary line extends and in a direction in which the first light source and the second light source are aligned.

3. The vehicle lighting according to claim 1, wherein the projection lens has a third lens body located at a side facing the emission section, the emission section has a lens surface configured to condense the first light and the second light in a direction in which the boundary line extends, and the third lens body has a lens surface configured to condense the first light and the second light emitted from the emission section in a direction in which the first light source and the second light source are aligned.

4. The vehicle lighting according to claim 3, wherein the third lens body is integrally assembled to the first lens body in a state in which an air layer is provided between the third lens body and the emission section.

5. The vehicle lighting according to claim 1, wherein the first light source and the second light source are provided on a same surface of a same substrate.

6. The vehicle lighting according to claim 1, wherein the first light projected by the projection lens forms a first light distribution pattern including a cutoff line defined by the boundary line on an upper end thereof, and the second light projected by the projection lens forms a second light distribution pattern located above the first light distribution pattern.

* * * * *